US006839936B2

(12) United States Patent
Kaufman

(10) Patent No.: US 6,839,936 B2
(45) Date of Patent: Jan. 11, 2005

(54) LATCHING STAIR ROD ASSEMBLY

(76) Inventor: Benjamin I. Kaufman, 610 Willis Ave., Williston Park, NY (US) 11596

( * ) Notice: Subject to any disclaimer, the term of this patent is extended or adjusted under 35 U.S.C. 154(b) by 0 days.

(21) Appl. No.: 10/247,175

(22) Filed: Sep. 19, 2002

(65) Prior Publication Data

US 2003/0097729 A1 May 29, 2003

Related U.S. Application Data

(60) Provisional application No. 60/333,452, filed on Nov. 27, 2001.

(51) Int. Cl.[7] ..... A47G 27/06

(52) U.S. Cl. ..... 16/12; 16/4

(58) Field of Search ..... 16/4, 10–12, 13–15, 16/DIG. 3, DIG. 35; 248/251, 254, 264, 316.8, 224.51

(56) References Cited

U.S. PATENT DOCUMENTS

| | | | | | |
|---|---|---|---|---|---|
| 91,111 | A | * | 6/1869 | French | 16/11 |
| 484,708 | A | * | 10/1892 | Gates | 16/13 |
| 737,143 | A | * | 8/1903 | Richards | 16/15 |
| 843,521 | A | * | 2/1907 | Deitrick | 16/13 |
| 869,492 | A | * | 10/1907 | Joyner | 16/15 |
| 1,258,853 | A | * | 3/1918 | Baker | 16/14 |
| 1,385,311 | A | * | 7/1921 | Dupont | 16/10 |
| 1,402,253 | A | * | 1/1922 | Richardson | 16/10 |
| 1,624,392 | A | * | 4/1927 | Cleverly | 16/14 |
| 4,918,782 | A | * | 4/1990 | Zahedi | 16/11 |
| D342,437 | S | * | 12/1993 | Prezner | D8/380 |
| 5,960,516 | A | | 10/1999 | Zoroufy | |
| 6,338,179 | B1 | | 1/2002 | Blackstone | |

* cited by examiner

*Primary Examiner*—Robert J. Sandy
*Assistant Examiner*—Andre' L. Jackson
(74) *Attorney, Agent, or Firm*—Lilling & Lilling P.C.

(57) ABSTRACT

A mounting base component and an upper bracket component comprise the stair rod bracket. The mounting base component is secured to the tread in any suitable manner and it includes an aperture or an open, elongate channel. The upper bracket component conforms to the shape of the mounting base component, so that, when they are mounted together, they define a single, integral bracket. Extending out from the upper bracket component is a latch that latchably engages into the opening or channel of the mounting base. A stair rod can be easily removed or installed by sliding the upper bracket to disengage it and then by lifting it away from the mounting base. Assembly and disassembly of a stair rod bracket according to the present invention is not impeded or made difficult by the framework of the stairs.

6 Claims, 4 Drawing Sheets

20
18
14
16
20
24
22
12
10

52
50
42
54
28
44
56
49
46

34
24
40
32
38
30
22
26

LATCHING STAIR ROD ASSEMBLY

FIELD OF THE INVENTION

The present invention relates generally to the carpeting and hardware industries and, in particular, to a latching stair rod bracket design that facilitates installation and assembly of the stair rod brackets and stair rod, as well as the removal of a stair rod.

BACKGROUND OF THE INVENTION

Many conventional stair rod bracket designs comprise hinged designs, where a top portion of the bracket is attached to a base portion via a hinge mechanism. A bracket having such hinge design is difficult to attach to the stair tread and corresponding riser because the top portion can be swung open only as far as the stair riser will allow, thus obscuring the attached base and interfering with the installation of the mounting screws in the base portion. Blackstone (U.S. Pat. No. 6,338,179) shows one such design.

Another conventional stair rod bracket design is described in Zoroufy (U.S. Pat. No. 5,960,516), which is incorporated herein by reference. Generally, this stair rod bracket design comprises a transversely interconnecting slidable stair rod bracket design. With this design, a stair rod bracket comprises, for example, a top portion and a bottom portion, a plurality of projections and complementary shaped channels for receiving the projections disposed on the top and bottom portions, for transverse engagement of the top and bottom portions, and a travel stop on the bottom portion for stopping the lateral travel of the top portion with respect to the bottom portion. With this lateral slidable design, removal of the stair rod may be difficult due to minimal clearance between the bracket and the sidewall (or stair stringer) of the stair. Further, with this design, it is not possible to slide the bracket away from the sidewall of the stairs because the stair rod and the bracket as thus designed prevent such movement.

SUMMARY OF THE INVENTION

The present invention is directed to a latchable stair rod bracket design that facilitates the installation procedure and the assembly and disassembly of the brackets and the removal of the stair rod. In one embodiment of the present invention, a stair rod bracket comprises a separate mounting base component and upper bracket component. The mounting base is mounted to a stair riser and tread, preferably using two screws. In the mounting base there is an open channel groove and the upper bracket has a latch that latchably engages into the channel groove of the mounting base.

These and other objects, features and advantages of the present invention will be described or become apparent from the following detailed description of preferred embodiments, which is to be read in connection with the accompanying drawings.

DETAILED DESCRIPTION OF PREFERRED EMBODIMENTS

Figure 2:
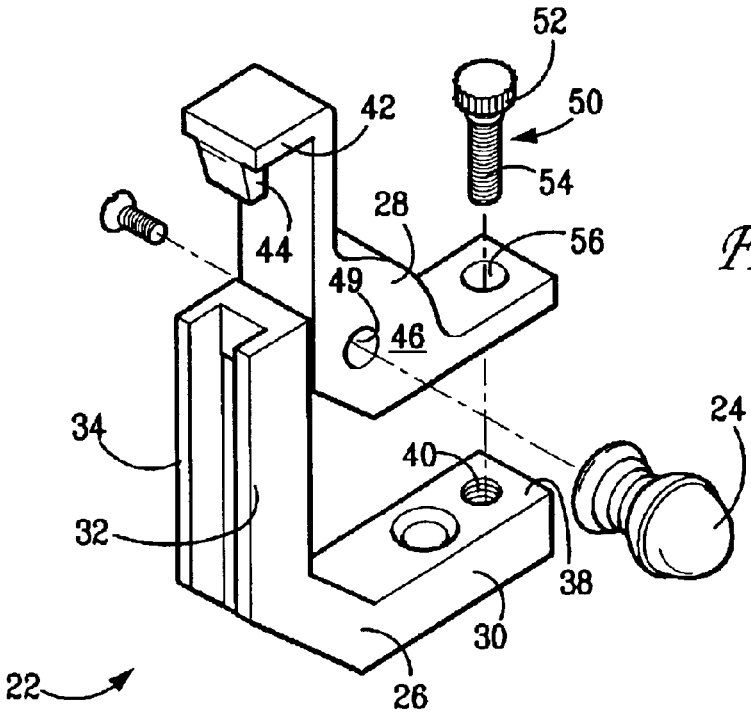
FIG. 2. is a perspective view of a latchable stair rod bracket according to an embodiment of the present invention.
Figure 3:
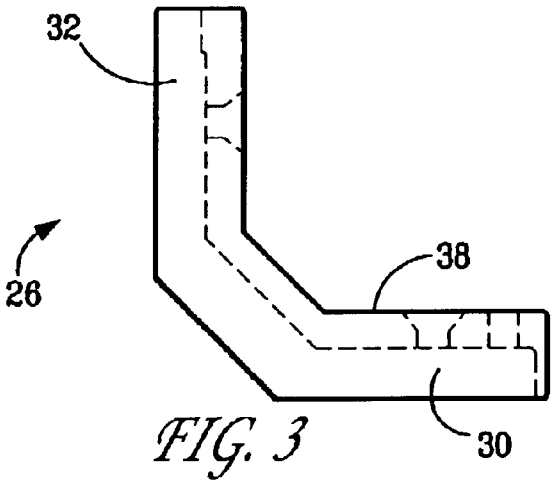
FIG. 3 is an inside side view of the mounting base component.
Figure 4:
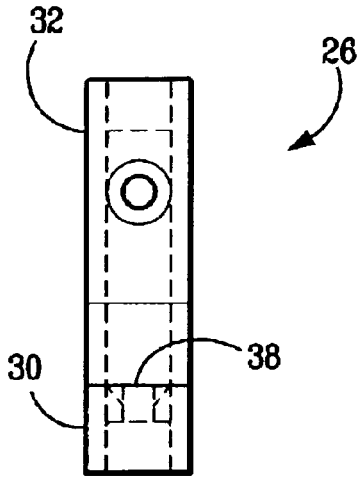
FIG. 4 is a front view of the mounting base component.
Figure 5:
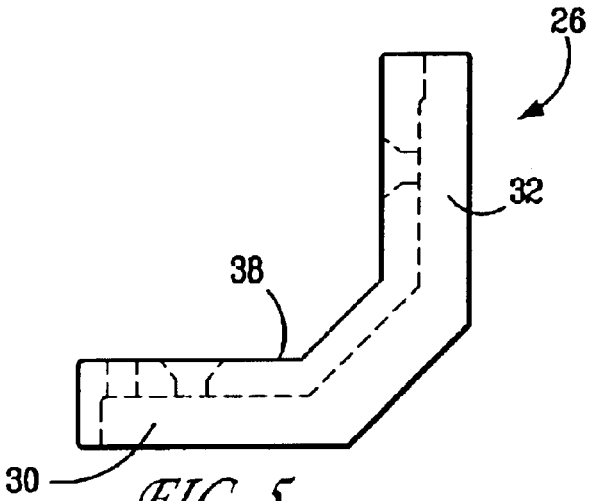
FIG. 5 is an outside side view of the mounting base component.
Figure 6:
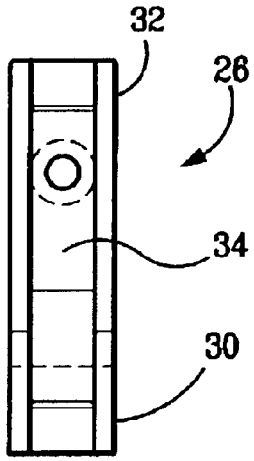
FIG. 6 is a rear view of the mounting base component.
Figure 7:
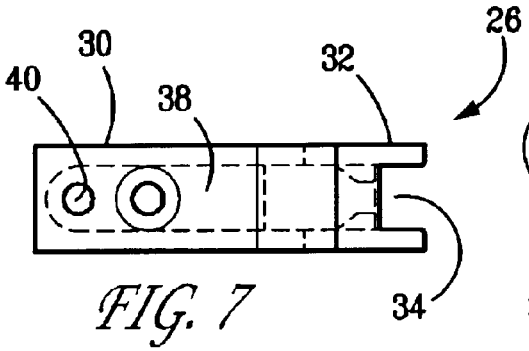
FIG. 7 is a top view of the mounting base component.
Figure 8:
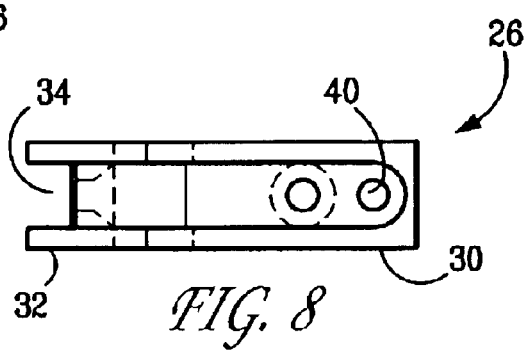
FIG. 8 is a bottom view of the mounting base component.
Figure 9:
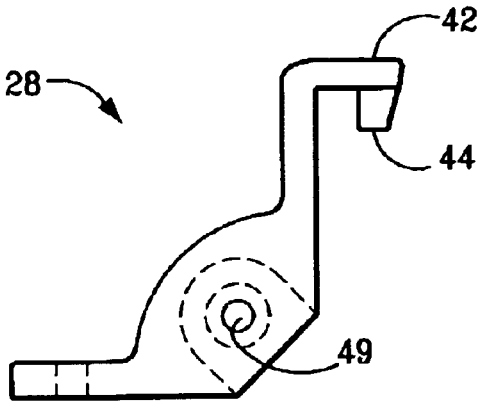
FIG. 9 is an outside side view of the upper bracket component.
Figure 10:
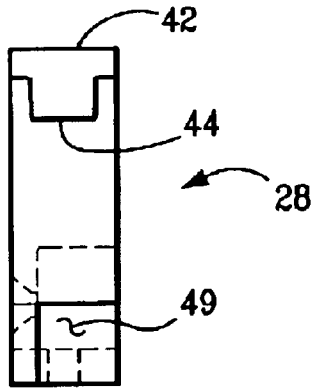
FIG. 10 is a rear view of the upper bracket component.
Figure 11:
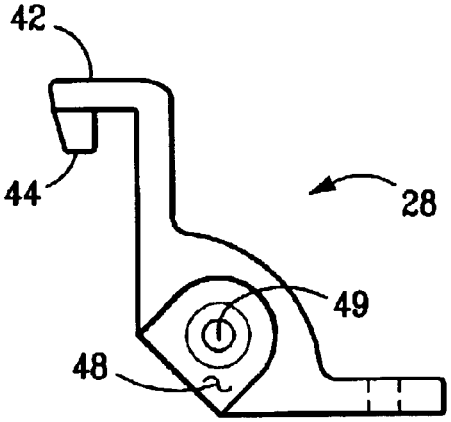
FIG. 11 is an inside side view of the upper bracket component.
Figure 12:
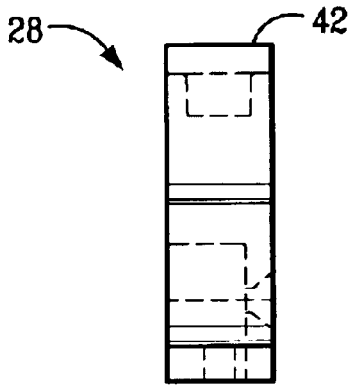
FIG. 12 is a front view of the upper bracket component.
Figure 13:
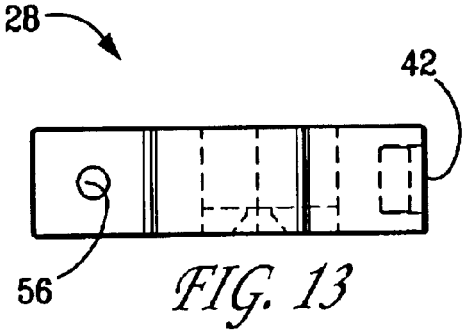
FIG. 13 is a top view of the upper bracket component.
Figure 14:
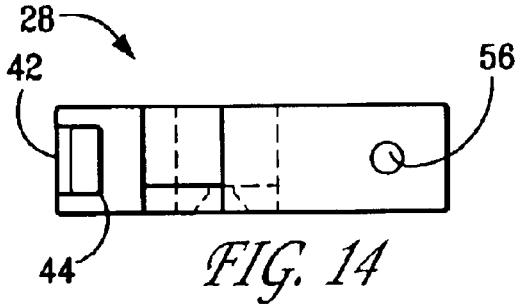
FIG. 14 is a bottom view of the upper bracket component.

The present invention is directed to a latchable stair rod bracket design that facilitates the installation procedure and the assembly and disassembly of the stair rod bracket and the removal of a stair rod. FIG. 2 is a perspective view of a latchable stair rod bracket according to an embodiment of the present invention.

Carpeting, carpet runners and other floor covering are often used to cover the stairs of a staircase. Stair rods are frequently used, both for their decorative aspects, as well as their functional attributes in bearing against the covering on the stairs.

Figure 1:
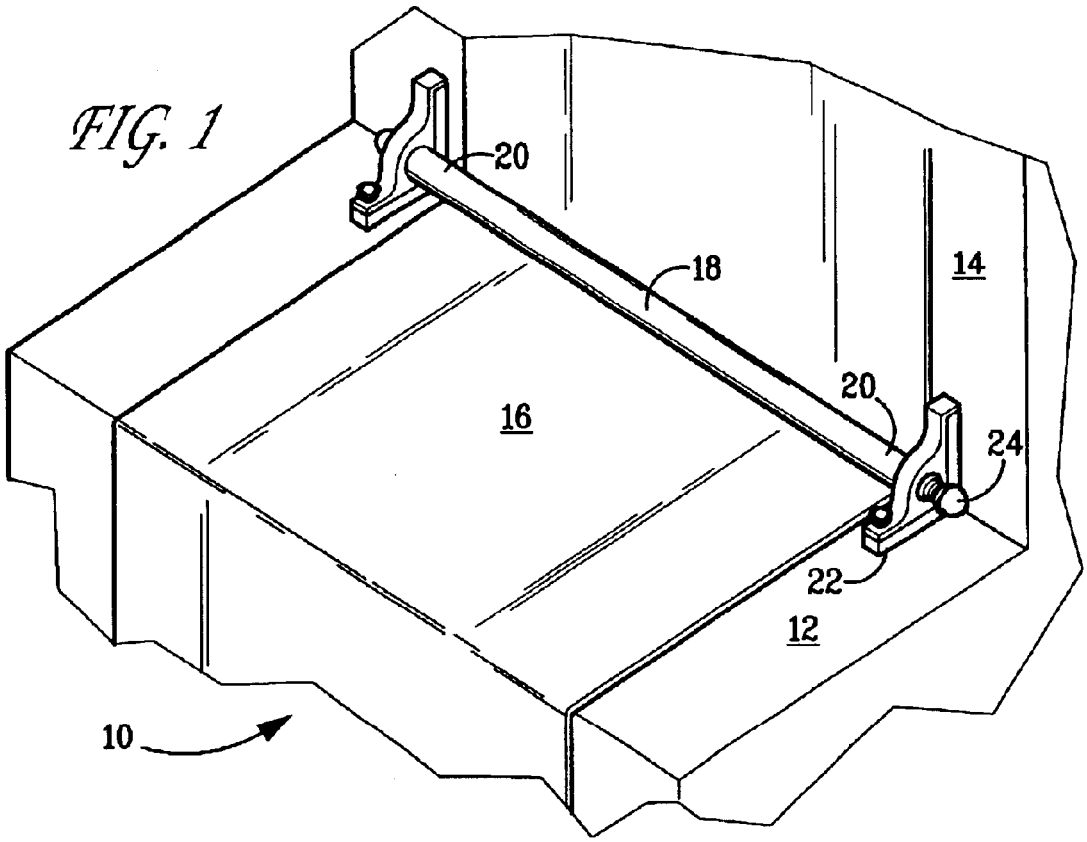
FIG. 1 is a perspective view of a stair riser bar in position on a staircase, and showing the latchable stair rod brackets of this invention.

As shown in FIG. 1, a standard staircase 10 may have any number of steps or treads 12 connected by risers 14. The specific number of treads and risers will depend on the location and size of the staircase, as is well known. For illustrative purposes, a carpet runner 16 is shown in place, and is stretched to exactly cover the tread and risers, as is known in the industry.

Stair rods 18 are then used for both decorative purposes, and also for securing the covering in place. As is well know, the ends 20 of the stair rod are held in the stair rod brackets 22. One way to do this is to use a finial 24, as taught in Zoroufy (U.S. Pat. No. 5,960,516). The finial has an enlarged head with a threaded shaft. This threaded shaft passes through an opening in the bracket and its end is screwed into a threaded opening in the end of the stair rod. Alternatively, the opening in the bracket can be made to a suitable size so that the stair rod is held in place with a friction fit in the bracket.

The stair rod brackets 22 are mirror images of each other, and, therefore, only one of them will be described herein (see FIG. 2). It may be appreciated that the other bracket is made in the same manner, but oriented for the other side of the staircase. The carpet rod is held in place by opposing blind openings in the left and right stair rod brackets. For aesthetic reasons, a finial may be attached to the bracket.

A mounting base component 26 and an upper bracket component 28 comprise the stair rod bracket 22. The mounting base component 26 has a horizontal segment or leg 30 secured to the stair tread 12 in any suitable manner, as by screws or adhesives. A vertical segment or leg 32 is secured to the stair riser. In the vertical leg 32 of the mounting base component 26 there is an aperture or an open, elongate channel 34. For reasons that will be hereinafter explained, on a top surface 38 of the horizontal segment 30, there is a threaded opening 40.

The upper bracket component 28 conforms to the shape of the mounting base component 26, so that, when they are mounted together, they define a single, integral bracket. Extending downward from the top 42 of the upper bracket component 28 is a latch 44 that latchably engages into the opening or channel 34 of the mounting base 26. As may be appreciated, it is only necessary for the opening or groove to be deep enough to securely hold the latch, and it is not necessary for the opening or groove to extend the entire length of the vertical leg 32 of the mounting base component 26.

Within the central region 46 of the upper bracket component 28, there is an opening 48 on the inside-facing surface to hold the ends of the stair rod, in one of the heretofore-mentioned manners. If a finial is used for aesthetic purposes, then it would be attached through an opening 49 on the outside-facing surface of the bracket.

To secure the mounting base component 26 and the upper bracket component 28 securely together, a screw device 50 is used. It may have an enlarged head 52 for gripping, and the surface may be knurled or slotted to facilitate handling. A threaded shaft 54 extends from the enlarged head. On the upper surface of the central portion of the upper bracket component 28 there is an opening 56 through which the threaded shaft 54 extends. The end of the threaded shaft 54 is screwed into the threaded opening 40 in the mounting base component 26. In this manner the pieces can be held securely together.

Advantageously, with this invention, the lower portion of the bracket (i.e., base) is readily installed with one screw to the stair riser and a second screw to the stair tread. This can be done quickly by the installer. Additionally the stair rod and upper portion of the bracket can easily be removed or installed (for cleaning or carpet replacement) by unscrewing the screw device and pulling the upper bracket up and away from the mounting base. Assembly and disassembly of a stair rod bracket according to the present invention is not impeded or made difficult by the framework of the stairs.

Figure 15:
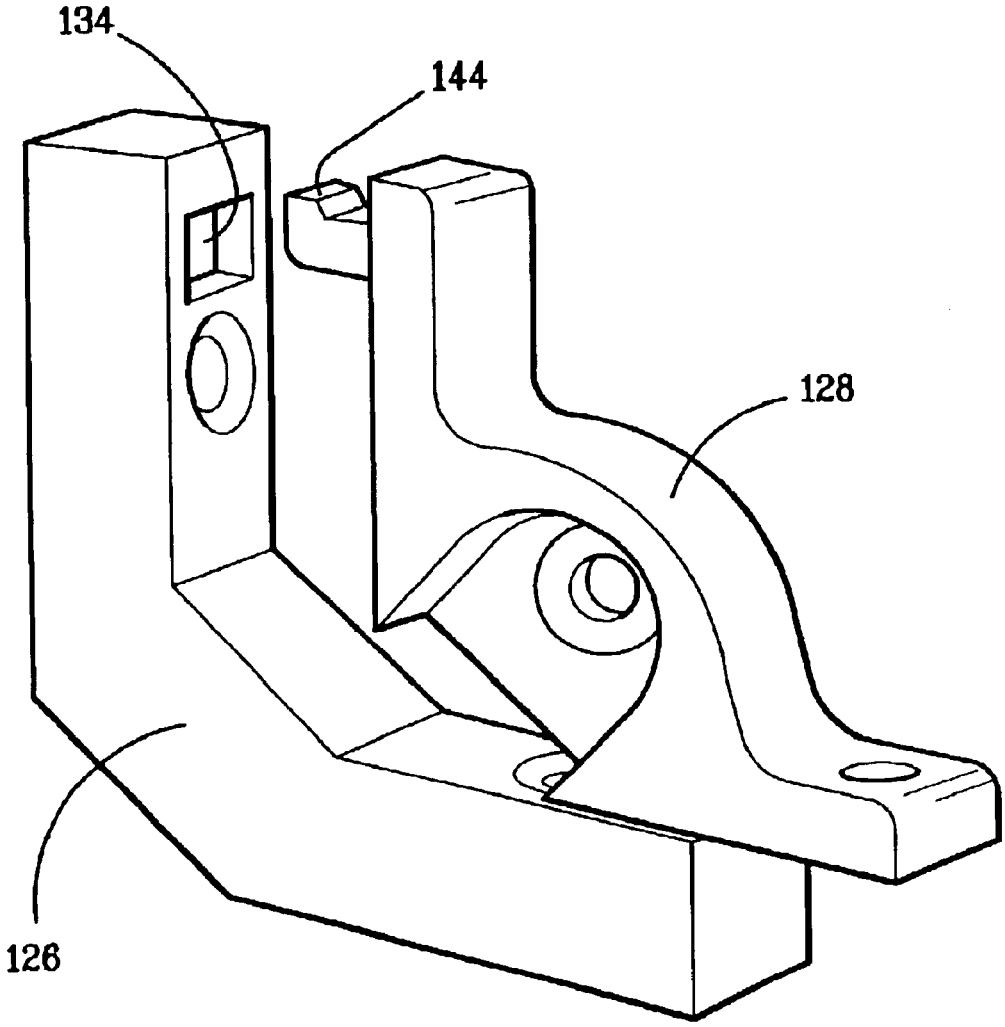
FIG. 15 is a perspective view of an alternate embodiment, similar to FIG. 2.

In some arrangements, it may be desirable to have the latch on the mounting base 26, and the opening or groove in the upper bracket component 28. Such a structure would work in the same basic manner. Another alternate embodiment is shown in FIG. 15. Here the mounting base 126 has an opening 34 on its inner vertical surface. Extending out horizontally (not down) from the upper portion of the upper bracket component 128 is the latch 144. The latch fits into the opening and a slight hook or bend at the end of the latch holds the latch in the opening.

The particular size of the brackets will depend on the diameter of the stair rod. The greater the rod diameter, the larger the bracket needs to be. The length of the latch must be sufficient to enter the opening or groove sufficiently deeply that the pieces will hold together without separating.

As designed, the upper bracket component can only move vertically, as the latch prevents movement in any other direction. This prevents the upper bracket component from acting as a lever/fulcrum. Any stress placed on the screw device 50 will not overwhelm it, as the screw device is basically meant to be for finger tightening.

A stair rod bracket according to one embodiment of the present invention may be used with a stair rod comprising a ½ or ⅝ inch O.D. (outer diameter) tubular rod. The components of the stair rod bracket may be made of solid brass, coated to prevent tarnishing.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

I claim:

1. A device for securing a stair rod to a stairway comprising a mounting base component having a first segment secured to a stair tread of said stairway and having a second segment secured to a riser of said stairway, said second segment having an opening directed in a vertical direction; a upper bracket component having a vertically directed latch that fits into and is held within said opening of said second segment, wherein said first and second segments move vertically with respect to each other, and an inner side surface of said upper bracket component having an opening for holding said stair rod; and means for securing together said mounting base component and said upper bracket component.

2. A device according to claim 1, wherein said mounting base component has an elongate channel for receiving said latch.

3. A device according to claim 1, wherein said upper bracket component conforms in shape to said mounting base component.

4. A device according to claim 1, wherein said means for securing includes a screw device that passes through an opening in said upper bracket component and is held in a threaded hole in said mounting base component.

5. A device according to claim 1, wherein said opening directed in a vertical direction in said second segment is located in a portion of said second segment facing said riser of said stairway.

6. A device according to claim 5, wherein said opening directed in a vertical direction is an elongate channel.

* * * * *